US006172452B1

(12) United States Patent
Itaya et al.

(10) Patent No.: US 6,172,452 B1
(45) Date of Patent: Jan. 9, 2001

(54) LOW PRESSURE MERCURY VAPOR DISCHARGE LAMP WITH HEAT CONDUCTIVE COMPONENT

(75) Inventors: Kenji Itaya; Shiro Iida, both of Osaka; Kenji Nakano, Kyoto; Masao Yukawa, Osaka, all of (JP)

(73) Assignee: Matsushita Electronics Corporation, Osaka (JP)

( * ) Notice: Under 35 U.S.C. 154(b), the term of this patent shall be extended for 0 days.

(21) Appl. No.: 09/116,753

(22) Filed: Jul. 16, 1998

(30) Foreign Application Priority Data

Sep. 10, 1997 (JP) ..... 9-245063

(51) Int. Cl.[7] ..... H01J 61/24
(52) U.S. Cl. ..... 313/490; 313/493; 315/108
(58) Field of Search ..... 313/490, 493; 315/108, 117

(56) References Cited

U.S. PATENT DOCUMENTS 4,794,301 * 12/1988 Misono et al. ..... 313/490
5,274,305 * 12/1993 Bouchard ..... 315/108
5,912,536 * 6/1999 Michiels et al. ..... 313/490

FOREIGN PATENT DOCUMENTS 61-225753 10/1986 (JP) ..... H01J/61/28

* cited by examiner

*Primary Examiner*—Michael H. Day
(74) *Attorney, Agent, or Firm*—Morrison & Foerster LLP

(57) ABSTRACT

A low pressure mercury vapor discharge lamp comprising a fluorescent tube having an amalgam container containing amalgam to control mercury vapor pressure at a steady lighting, a holder holding both ends of the fluorescent tube, a lighting circuit to light the fluorescent tube, a case accommodating the lighting circuit, and a base provided to the case, wherein the amalgam container and the base are connected with each other by a heat conductive component, so that the amalgam temperature is controlled at a proper value and the luminous efficiency is improved.

11 Claims, 1 Drawing Sheet

LOW PRESSURE MERCURY VAPOR DISCHARGE LAMP WITH HEAT CONDUCTIVE COMPONENT

FIELD OF THE INVENTION

This invention generally relates to a low pressure mercury vapor discharge lamp using amalgam and, more particularly, to a low pressure mercury vapor discharge lamp that controls the amalgam temperature and improves the luminous efficiency.

BACKGROUND OF THE INVENTION

In a general type of low pressure mercury vapor discharge lamp, such as a light-bulb-shaped fluorescent lamp comprising an outer housing accommodating a fluorescent tube whose inner surface is covered with a phosphor, the mercury vapor pressure in the tube is controlled at a proper value by using an amalgam in order to prevent deterioration of luminous efficiency at a high temperature. In this case, the luminous efficiency depends on the temperature of the amalgam. The luminous efficiency will deteriorate when the amalgam temperature exceeds the proper value. In other words, the problem with the general low pressure mercury vapor discharge lamp is how to control the upper limit of the amalgam temperature.

In order to solve the above problem, a low pressure mercury vapor discharge lamp with amalgam temperature control is suggested, and this is accomplished in the prior art by covering the outer surface of a slender pipe containing amalgam with a heat radiation auxiliary component of a resin whose heat conductivity is better than that of the air. A further preferable example is disclosed in Japanese Laid-Open Patent Application (Tokukai-Sho) No. 61-225753, which discloses a low pressure mercury vapor discharge lamp in which a heat radiation auxiliary component covering a slender pipe contacts a housing, and the heat of the slender pipe is dissipated through the cover to the open air side.

Such a conventional low pressure mercury vapor discharge lamp comprises a slender pipe containing an amalgam. The outer surface of the pipe is covered with a heat radiation auxiliary component of a resin whose heat conductivity is better than that of the air, and the heat radiation auxiliary component is contacted with a housing. There is not, however, a sufficient difference between the temperature of the space in the housing and of the housing's inner surface in contact with the heat radiation auxiliary component, and the temperature of the amalgam container at the steady lighting of the lamp. Therefore, the heat of the amalgam container is not fully radiated, an the overheating of the amalgam cannot be fully controlled.

As such, there remains an opportunity to improve the low pressure mercury vapor discharge lamp. In particular, there exists a need for a low pressure mercury vapor discharge lamp that controls the amalgam temperature at a proper value and improves the luminous efficiency.

SUMMARY OF THE INVENTION

This invention aims to solve the above-mentioned problem by providing a low pressure mercury vapor discharge lamp that controls the amalgam temperature at a proper value and improves the luminous efficiency.

A low pressure mercury vapor discharge lamp of this invention comprises a fluorescent tube having an amalgam container containing amalgam to control mercury vapor pressure at a steady lighting, a holder holding both ends of the fluorescent tube, a lighting circuit to light the fluorescent tube, a case accommodating the lighting circuit, and a base for the case. The amalgam container and the base are connected to each other by a heat conductive component. The heat conductivity K of the heat conductive component is preferably at a value of $K \geqq 200$ ($W \cdot m^{-1} \cdot K^{-1}$) at 100° C. Preferable radiation efficiency can be obtained as the heat conductivity is high.

In the configuration, the heat of the amalgam container can be conducted via the heat conductive component to the base for radiation, so that the overheating of the amalgam can be fully controlled. As a result, the mercury vapor pressure can be controlled at a proper value, and the luminous efficiency can be improved.

It is preferable that the low pressure mercury vapor discharge lamp further comprises a globe to accommodate the holder and to compose an outer housing with the case.

It is preferable in the low pressure mercury vapor discharge lamp that the heat conductive component comprises a metallic material.

It is preferable in the low pressure mercury vapor discharge lamp that the metallic material is at least one material selected from the group consisting of gold, silver, copper and aluminum.

It is preferable in the low pressure mercury vapor discharge lamp that the heat conductive component comprises a heat conductive silicone rubber material.

It is also preferable in the low pressure mercury vapor discharge lamp that the heat conductive component comprises carbon (graphite).

The above features and advantages of the invention will be better understood from the following detailed description taken into conjunction with the accompanying drawing.

DETAILED DESCRIPTION OF THE INVENTION

Figure 1:
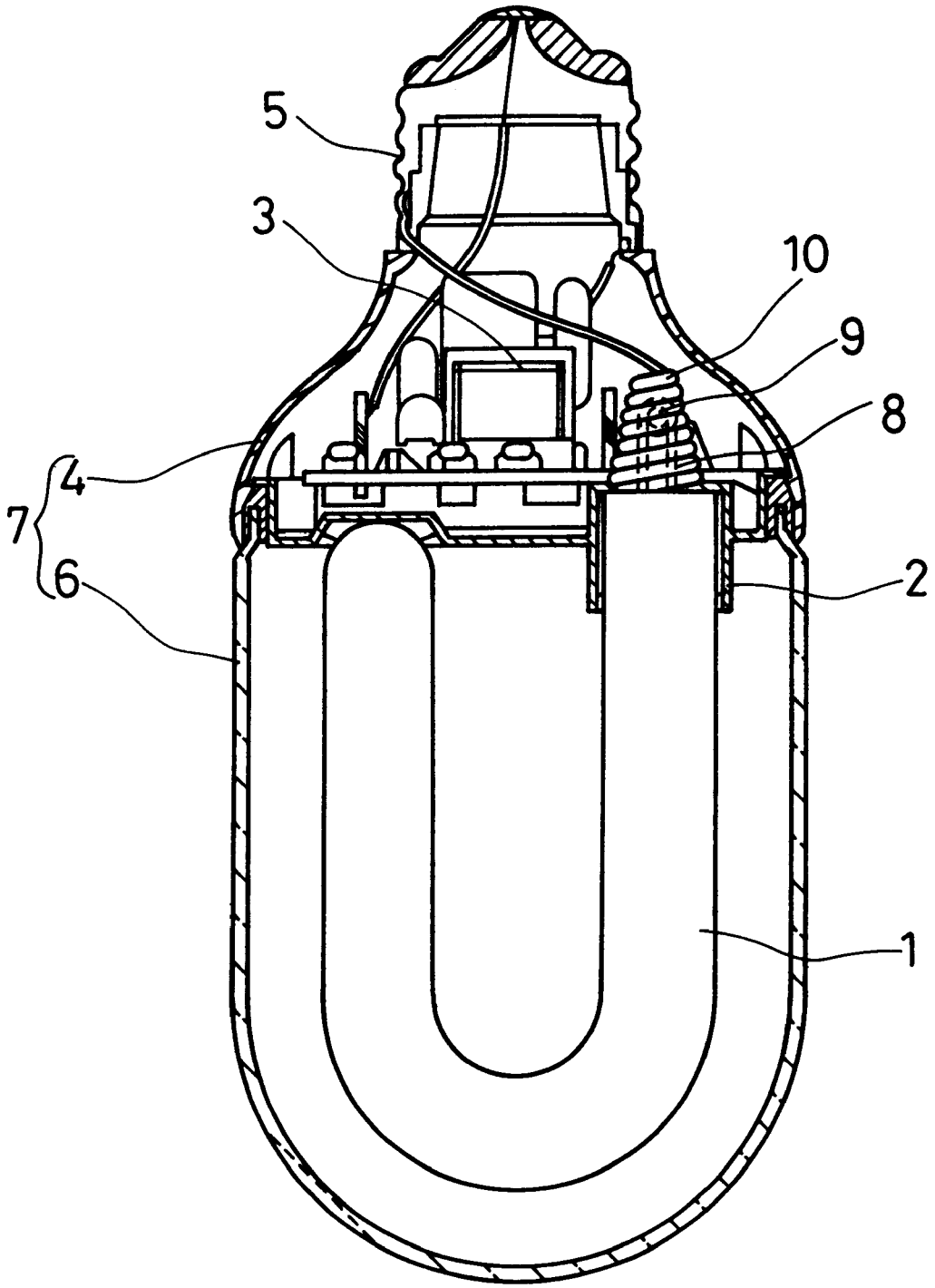
FIG. 1 is a sectional frontal view of a light-bulb-shaped fluorescent lamp in an embodiment of this invention.

As shown in FIG. 1, a light-bulb-shaped fluorescent lamp of an embodiment of this invention comprises a bent fluorescent tube 1, a holder 2 holding both ends of the fluorescent tube 1, a lighting circuit 3 to light the fluorescent tube 1, a resin case 4 accommodating the lighting circuit 3, a metallic base 5 provided for the resin case 4, and a globe 6 that accommodates the fluorescent tube 1 held by the holder 2 and composes an outer housing in combination with the resin case 4. Amalgam 9 is filled in a slender pipe as an amalgam container 8 at one end of the fluorescent tube 1 so as to control the mercury vapor pressure inside the fluorescent tube 1 at a steady lighting condition. The globe 6 is not an essential component, that is, the fluorescent tube 1 can be exposed without the globe.

The outer surface of the slender pipe filled with amalgam and the inner screw part of the base 5 are connected to each other by a heat conductive component 10. Accordingly, the heat of the amalgam container 8 can be conducted via the heat conductive component 10 to the base 5 for heat radiation, and, as a result, the overheating of the amalgam can be fully controlled. Moreover, the mercury vapor pressure can be easily controlled at a proper value, and the luminous efficiency can be improved.

The heat conductive component 10 is linear, and one end of the linear component 10 is wound around the outer surface of the amalgam container 8, while the other end is sandwiched between the case 4 and the base 5 and connected to the base 5. Since the area where heat is sandwiched in the heat conductive component 10 and the base 5 contact is larger, the heat is rapidly radiated to the power source. The contacting area in this embodiment is determined to be 5 $mm^2$. The heat conductive component 10 comprises a metallic material with good heat conductivity, such as a band of copper wires. To ensure electric insulation between the heat conductive component 10 and the lighting circuit 3, the heat conductive component 10 may be covered with electric insulation. The electric insulation treatment includes coating of resin (varnish) such as polyimide on the surface of the metallic wires such as copper wires.

In this embodiment, copper is used for the heat conductive component 10. Similar effects can be obtained by using some other metallic materials with good heat conductivity, such as gold, silver, and aluminum, or by using other materials with good heat conductivity, such as carbon. If the heat conductive component 10 comprises a heat conductive silicone rubber material (e.g., a silicone rubber mixed with metallic fine powder: "SARCON" made by Fuji Polymer Industries Co., Ltd.), the heat conductive component provides electric insulation by itself, so no treatment is required to provide electric insulation between the heat conductive component 10 and the lighting circuit 3.

The light-bulb-shaped fluorescent lamp of this embodiment is used after attaching the base 5 to a power source for lighting equipment, i.e., to apply power (not shown) to the base of the lighting equipment.

Temperatures within a light-bulb shaped fluorescent lamp produced in this embodiment (hereinafter "present product") are measured in the amalgam container, the inner surface of the case, and the surface inside the base, at a steady lighting condition under a room temperature atmosphere. The results are shown in Table 1.

Table 1 also shows the results with regard to three kinds of conventional light-bulb-shaped fluorescent lamps. "Conventional product 1" is a light-bulb-shaped fluorescent lamp with a slender pipe to which no heat radiation component is provided; "Conventional product 2" is a light-bulb-shaped fluorescent lamp in which the outer surface of a slender pipe containing amalgam is covered with a heat radiation auxiliary component comprising a resin whose heat conductivity is better than that of air; and "Conventional product 3" is a light-bulb-shaped fluorescent lamp in which the heat radiation auxiliary component is contacted with the case.

| | Present Product | Conventional Product 1 | Conventional Product 2 | Conventional Product 3 |
|---|---|---|---|---|
| I (° C.) | 70.0 | 93.2 | 92.0 | 90.4 |
| II (° C.) | 85.3 | 85.3 | 85.2 | 85.5 |
| III (° C.) | 58.5 | 58.2 | 58.3 | 58.4 |

*I Temperature of amalgam container
II Temperature of inner surface of the case
III Temperature of surface inside the base As clearly shown in Table 1, the heat of the amalgam container 8 of the present product can be effectively radiated from the base 5 via the heat conductive component 10 when compared to the Conventional products 1–3, and thus, the overheating of the amalgam can be fully controlled.

As mentioned above, a light-bulb-shaped fluorescent lamp of the invention conducts the heat of the amalgam container 8 to the base 5 via the heat conductive component 10 to radiate from the base 5 to the power source, so that the overheat at the amalgam can be fully controlled. As a result, the mercury vapor pressure can be controlled at a proper value, and the luminous efficiency can be improved.

The invention may be embodied in other forms without departing from the spirit or essential characteristics thereof. The embodiments disclosed in this application are to be considered in all respects as illustrative and not limitative, the scope of the invention is indicated by the appended claims rather than by the foregoing description, and all changes which come within the meaning and range of equivalency of the claims are intended to be embraced therein.

What is claimed is:

1. A low pressure mercury vapor discharge lamp comprising a fluorescent tube having an amalgam container containing amalgam to control mercury vapor pressure at a steady lighting condition, a holder holding both ends of the fluorescent tube, a lighting circuit to light said fluorescent tube, a case accommodating said lighting circuit, and a base provided on said case, wherein said amalgam container and said base are thermally connected with each other by a heat conductive component, the heat conductive component being formed such that one end thereof is wound around the outer surface of the amalgam container while the other end is sandwiched between the case and the base and connected to the base, and the heat of the amalgam container to be radiated is conducted to the base via the heat conductive component.

2. The low pressure mercury vapor discharge lamp of claim 1, further comprising a globe to accommodate said holder and to form an outer housing for said lamp together with said case.

3. The low pressure mercury vapor discharge lamp of claim 1, wherein said heat conductive component comprises a metallic material.

4. The low pressure mercury vapor discharge lamp of claim 3, wherein said metallic material is at least one material selected from the group consisting of gold, silver, copper and aluminum.

5. The low pressure mercury vapor discharge lamp of claim 1, wherein said heat conductive component comprises a heat conductive silicone rubber material.

6. The low pressure mercury vapor discharge lamp of claim 1, wherein said heat conductive component comprises carbon.

7. The low pressure mercury vapor discharge lamp of claim 1, wherein the area where the heat conductive component and the base contact each other is about 5 $mm^2$.

8. The low pressure mercury vapor discharge lamp of claim 1, wherein the heat conductive component is a band of copper wires.

9. The low pressure mercury vapor discharge lamp of claim 1, wherein the heat conductive component is covered with electric insulation.

10. The low pressure mercury vapor discharge lamp of claim 1, wherein the heat conductivity K of the heat conductive component at 100° C. has a value of $K \geqq 200$ $(W \cdot m^{-1} \cdot K^{-1})$.

11. A low pressure mercury vapor discharge lamp comprising:

a fluorescent tube having an amalgam container containing amalgam to control mercury vapor pressure for steady lighting;

a lighting circuit to light the fluorescent tube;

a base to support the fluorescent tube and the lighting circuit; and a heat conductive component for connecting the amalgam container and the base, the heat conductive component being formed such that one end thereof is wound around the outer surface of the amalgam container while the other end is sandwiched between the case and the base and connected to the base, and the heat of the amalgam container to be radiated is conducted to the base via the heat conductive component.

* * * * *